United States Patent [19]

Parker

[11] Patent Number: 4,867,505

[45] Date of Patent: Sep. 19, 1989

[54] ADJUSTABLE LOUNGE CHAIR

[75] Inventor: Paul H. Parker, Poultney, Vt.

[73] Assignee: Telescope Casual Furniture, Inc., Granville, N.Y.

[21] Appl. No.: 723,663

[22] Filed: Apr. 16, 1985

Related U.S. Application Data

[63] Continuation of Ser. No. 416,256, Sep. 9, 1982, abandoned.

[51] Int. Cl.[4] ..... A47C 4/00; A47C 1/02

[52] U.S. Cl. ..... 297/27; 297/34; 297/359

[58] Field of Search ..... 297/16, 27, 34, 342, 297/353–355, 359, 360, 381

[56] References Cited

U.S. PATENT DOCUMENTS

| | | | |
|---|---|---|---|
| 2,681,099 | 6/1954 | Vallone | 297/360 X |
| 2,719,688 | 10/1955 | Seifert | 248/191 |
| 2,973,888 | 3/1961 | Beardsley | 224/9 |
| 4,258,951 | 3/1981 | Groom | 297/16 |
| 4,514,009 | 4/1985 | Vanderminden et al. | 297/35 X |

FOREIGN PATENT DOCUMENTS

| | | | |
|---|---|---|---|
| 18772 | 11/1980 | European Pat. Off. . | |
| 701339 | 12/1940 | Fed. Rep. of Germany | 297/27 |
| 80988 | 5/1951 | Fed. Rep. of Germany | 297/359 |
| 867901 | 1/1953 | Fed. Rep. of Germany . | |
| 1402541 | 5/1965 | France | 297/359 |

*Primary Examiner*—Peter R. Brown

*Attorney, Agent, or Firm*—Kenyon & Kenyon

[57] ABSTRACT

The adjustable lounge chair is pivotal from an upright position into a reclined position via the use of telescoping arms of the arm frame. Spring biased buttons are used to releasably hold the telescoping arms and, thus, the back frame in the upright position. When the buttons are released, the telescoping arms slide within the fixed arms of the arm frame to permit the back frame to pivot into the reclined position.

10 Claims, 2 Drawing Sheets

ADJUSTABLE LOUNGE CHAIR

This is a continuation of application Ser. No. 416,256, filed Sept. 9, 1982, now abandoned.

This invention relates to an adjustable lounge chair. More particularly, this invention relates to an adjustable lounge chair for outdoor use.

Heretofore, various types of lounge chairs have been known for outdoor use. For example, lounge chairs of the back-rest type which are used at poolside or on beaches have generally been constructed with a seat which is situated at a limited height above ground to permit an occupant's legs to be extended substantially horizontally in a rest position. In some cases, these lounge chairs have been constructed of three generally U-shaped frames such that one frame forms a seat frame, a second frame forms and arm frame and a third frame forms a back frame. Usually, the frames have been articulated to each other to permit folding of the chair from an upright position to a collapsed condition. However, these chairs provide only one position for an occupant, i.e. the upright position.

Another known type of back-rest chair, for example as described in U.S. Pat. No. 3,495,868, has a back portion which is capable of being pivoted into substantial horizontal alignment with a seat portion to assume a lay-flat position. In addition, the back portion includes a curved end portion with a cross bar which is adapted to rest on the ground when the chair is in the lay-flat position. However, in order to permit pivoting of the back portion relative to the seat portion, the chair has been constructed with armrests which are pivotally secured to the back portion and slidably secured in a mount or bracket of the seat portion. In addition, the underside of each armrest is provided with a series of aligned holes or notches for receiving the upper portion of the mount so as to lock the armrest with respect to the seat portion. Guides are also provided to retain each mount in alignment with the holes in the underside of an armrest. However, such a construction is cumbersome to use, particularly if the armrests are not lifted from the respective mounts simultaneously to shift the back portion of the chair to another position.

Accordingly, it is an object of the invention to provide a lounge chair of backrest type which can be moved between a raised upright position and a lowered reclined position in a relatively simple manner.

It is another object of the invention to provide a lounge chair of bracket type which can be readily moved from an upright position to a reclined position.

It is another object of the invention to provide a simple construction for a backrest lounge chair which permits movement to different positions when in use.

It is another object of the invention to provide a relatively simple means for adjusting a lounge chair from an upright to a reclined position.

It is another object of the invention to provide a multi-position arm assembly for an adjustable lounge chair of simple construction.

Briefly, the invention provides an adjustable lounge chair which has a seat frame, an arm frame and a back frame.

The seat frame is constructed to define a first leg support and includes a seat which extends across the seat frame.

The arm frame is pivotally connected to the seat frame and is constructed to define a second leg support while including a pair of telescoping arms.

The back frame is pivotally mounted on the seat frame and is pivotally secured to the two telescoping arms to move between a raised upright position and a lowered reclined position. In addition, the back frame has a projecting portion at one end which defines a third leg support when in the lowered position and includes a back which extends across the back frame. When the back frame is in the lowered reclined position, the back is disposed in generally parallel relation with the seat of the seat frame.

The chair also has means for releasably holding the back frame in the raised position. For example, with the arm frame including a pair of parallel tubular arms with each telescoping arm slidably received in a respective arm, the releasable means includes an aperture in each respective arm and a spring biased button which is housed within a respective telescoping arm for projection through a respective aperture when in the raised position.

In use, for example, when the chair is in the upright position, the occupant may grasp the two arms and push the respective buttons of the holding means into the arms. This serves to release the telescoping arms so that the back frame may pivot rearwardly into the lowered reclined position. At this time, the telescoping arms simply slide within the tubular arms of the arm frame until the leg support of the back frame comes into contact with the ground surface. The occupant may then assume a fully reclined position.

In order to move from the reclined position to the upright position, the occupant merely leans forward and pulls the back portion into the upright position. At that time, the buttons of the releasable holding means are spring biased through the apertures in the arms to lock the telescoping arm in place.

Because the arm assembly uses telescoping arms, the pivoting motion of the back frame from the upright position to the reclined position can be carried out smoothly. That is, the telescoping arms serve to prevent skewing of the back frame relative to the arm frame and generally serves to guide the back frame in a uniform manner into the reclined position.

Further, release of the holding means is carried out in a simple fashion simply by depressing the buttons of the holding means into the arms.

These and other objects and advantages of the inventions will become more apparent from the following detailed description taken in conjunction with the accompanying drawings wherein.

Figure 1:
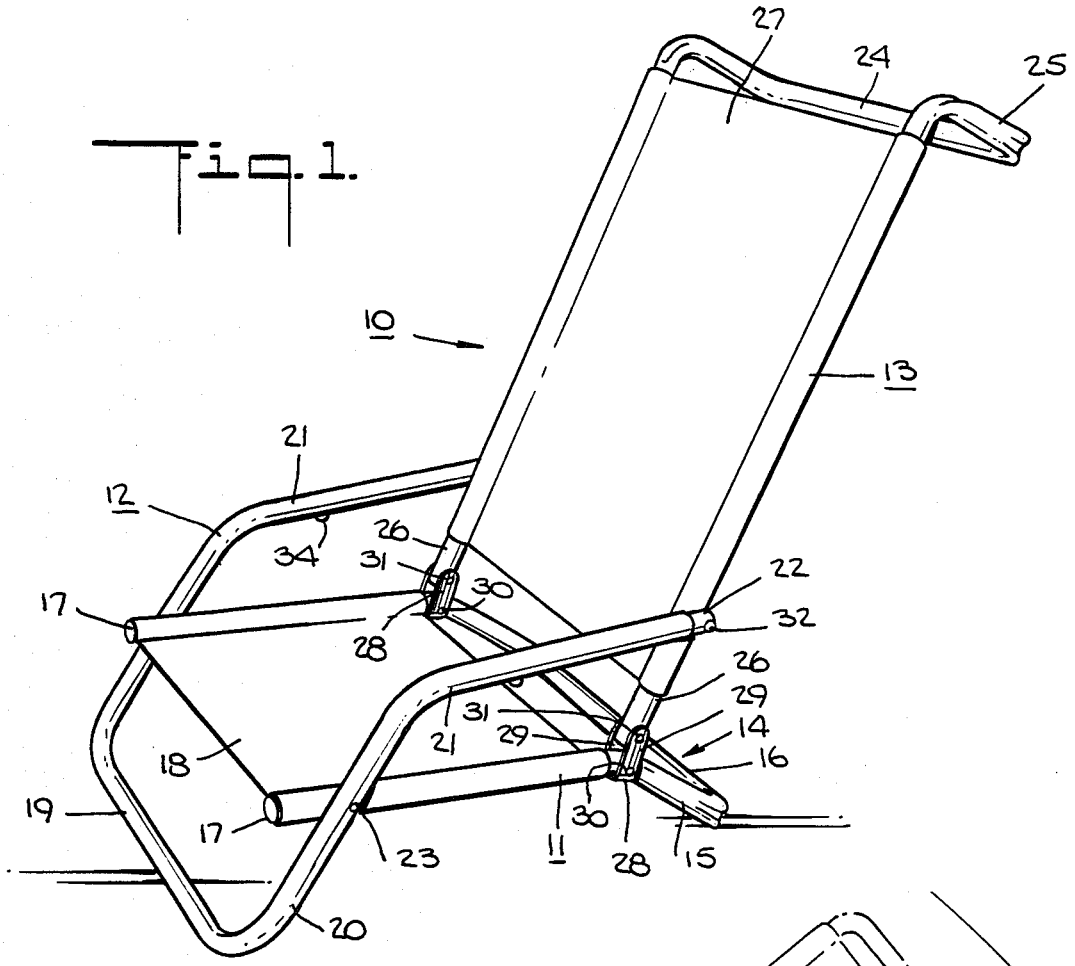
FIG. 1 illustrates a perspective view of the lounge chair in an upright position in accordance with the invention.

Referring to FIG. 1 the adjustable lounge chair 10 is constructed with a seat frame 11, an arm frame 12 and a back frame 13.

The seat frame 11 is formed of a generally U-shaped one-piece hollow tubular member 14 which is bent at one end to define a leg support 15. As indicated, a cross-bar 16 of the tubular member 14 rests on a ground surface while a pair of parallel arms 17 of the member 14 supports a seat 18 which extends across the frame 14. The seat 18 may be of any suitable material, such as a woven fabric material, a web material, or the like.

The arm frame 12 is also formed of a generally U-shaped one-piece hollow tubular member 19 which is bent at an intermediate point. As indicated, the tubular member 19 defines a leg support 20 and a pair of parallel arms 21 above the seat frame 11. In addition, the arm frame 12 includes a pair of telescoping arms 22 each of which is slidably received in a respective arm 21.

Figures 3, 4, 5, 6:
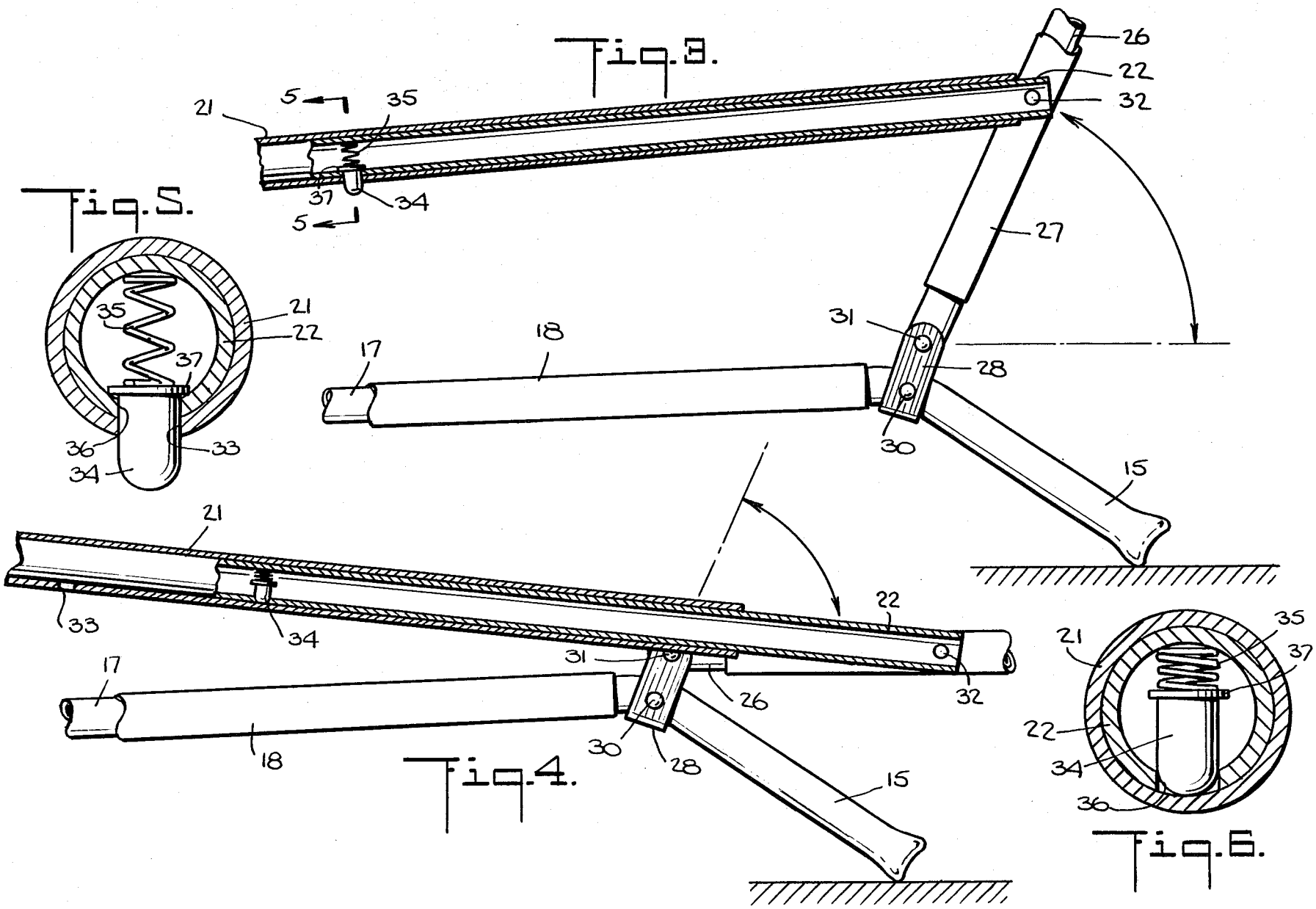
FIG. 3 illustrates a partial fragmentary view of a telescoping arm of the lounge chair in the upright position.
FIG. 4 illustrates a view similar to FIG. 3 of the telescoping arm in the reclined position.
FIG. 5 illustrates a view taken on line 5—5 of FIG. 3 of a releasable holding means in accordance with the invention.
FIG. 6 illustrates a view similar to FIG. 5 of the holding means in a released position.

Referring to FIGS. 3 and 5, each arm 21 is of hollow cylindrical shape while each telescoping arm 22 is in the form of a tube of cylindrical shape which is slidably received within an arm 21.

Referring to FIG. 1, the arm frame 12 is pivotally connected to the seat frame 11, for example via threaded bolts 23 which are passed through the arms 21 of the arm frame 12 into the arms 17 of the seat frame 11 in known manner.

Figure 2:
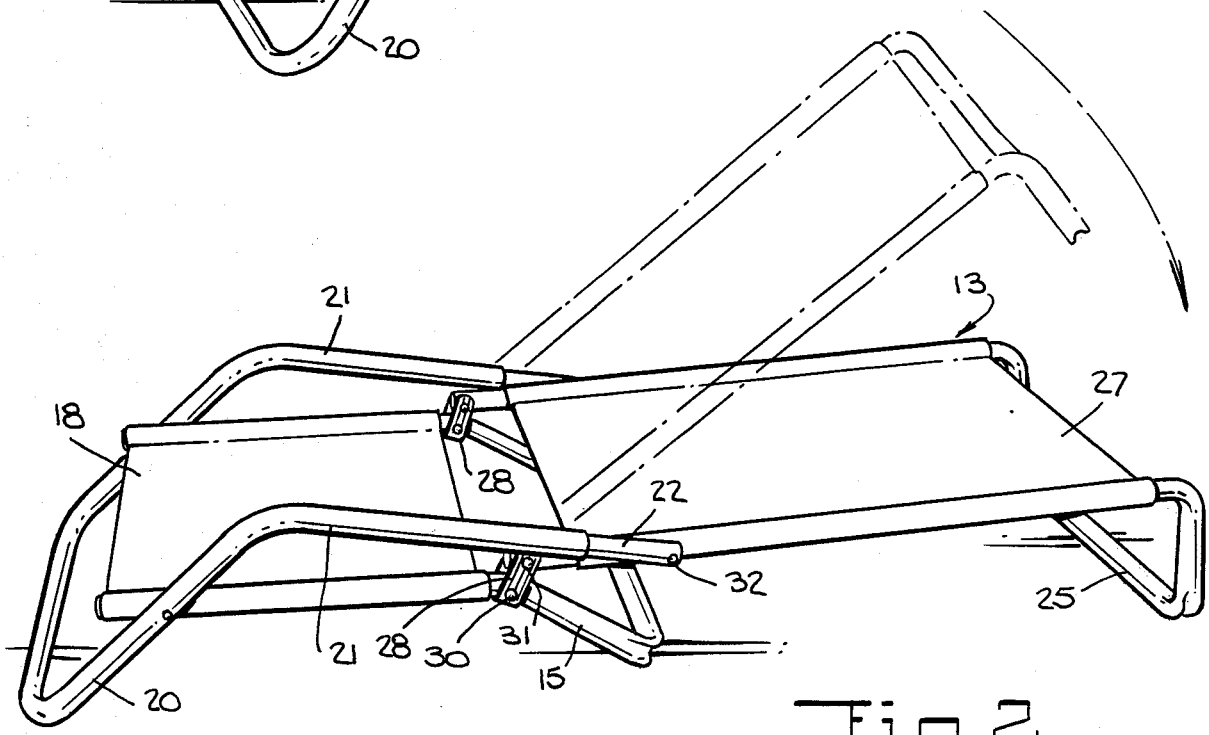
FIG. 2 illustrates a view of the lounge chair in a lowered reclined position in accordance with the invention.

The back frame 13 is also formed of a generally U-shaped one-piece hollow tubular member 24 and is pivotally mounted on the seat frame 11 in order to move between a raised upright position as shown in FIG. 1 and a lowered reclined position as shown in FIG. 2. The tubular member 24 is bent at the upper end, as viewed, to have a projecting portion which defines a third leg support 25 when in the lowered position. The tubular member 24 also has a pair of parallel arms 26 across which a back 27 extends. As above, the back 27 can be formed of any suitable material, such as a fabric or webbing.

As shown, the back frame 13 is pivotally mounted on the seat frame 11 via a pair of U-shaped brackets 28. Each bracket 28 has a pair of upstanding legs 29 which straddle an arm 17 of the seat frame 11 at the bend and is fixed, as by a pin or rivet 30 which passes through the legs 29 and arm 19. In addition, an arm 26 of the back frame 13 is pivotally secured between and to the legs 29 as by a pin or rivet 31.

Referring to FIGS. 1 and 3, each telescoping tube 22 of the arm frame 12 is pivotally secured to an arm 26 of the back frame 13 as by a pin or bolt 32 which passes through the tube 22 into the arm 26, for example in the same fashion as the arm frame 12 is pivotally secured to the seat frame 11.

Referring to FIGS. 3 and 5, the chair 10 is also provided with means for releasably holding the back frame 13 in the raised position. For example, the means includes an aperture 33 in each arm 21 of the arm frame 12, a button 34 which is housed within a respective telescoping tube 22 and a spring 35 which biases the button 34 outwardly. As indicated in FIG. 6, each button 34 projects through an aperture 36 in a tube 22 and carries a collar 37 which acts as a stop against the inside of the tube 22 in the locking position (FIG. 5).

When the chair 10 is in the upright position, as shown in FIG. 1, each button 34 projects through the respective arm 21 of the arm frame 12 as indicated in FIG. 5. When the chair 10 is in the reclined position, for example as shown in FIG. 2, each button 34 is disposed within a respective tubular arm 21 as indicated in FIG. 6.

When in use, the chair 10 can be readily moved from the upright position shown in FIG. 1 in which the chair 10 rests on the two leg supports 15, 20 to the reclined position shown in FIG. 2 wherein the chair 10 rests on the three leg supports 15, 20 and 25. To this end, the occupant merely grasps the arms 21 and depresses the buttons 34 into the arms 21. At this time, the telescoping tubes 22 are released so that the occupant, by leaning against the back frame 13, can pivot the back frame 13 into the reclined position shown in FIG. 2. In this latter position, the back 27 is in generally parallel relation with the seat 18 so as to comfortably receive an occupant in a reclining position.

Since the telescoping tubes 22 slide within the arms 21 of the arm frame 12, a smooth motion can be obtained when moving the back frame between the upright position and the reclined position and vice versa. Further, because of the guidance provided by the arms 21, the tubes 22 tend to move simultaneously. As a result, skewing of the back frame 13 can be avoided.

What is claimed is:

1. An adjustable lounge chair comprising a seat frame defining a first leg support;

an arm frame having a one-piece tubular member pivotally connected to said seat frame to define a second leg support and a pair of hollow arms, and a pair of telescoping arms, each said telescoping arm of said member being slidably received in a respective hollow arm;

a back frame pivotally mounted on said seat frame to move between a raised upright position and a lowered reclined position, said back frame having a projecting portion at one end to define a third leg supportin said lowered position and being pivotally secured at an intermediate portion to each telescoping arm; and means in said arm frame for releasably holding said back frame in said raised position.

2. An adjustable lounge chair as set forth in claim 1 wherein said means includes an aperture in each respective arm and a spring biased button housed within a respective telescoping arm for projection through a respective aperture in said raised position.

3. An adjustable lounge chair as set forth in claim 1 wherein said seat frame includes a seat extending across said seat frame and said back frame includes a back extending across said back frame, said back being disposed in generally parallel relation with said seat in said lowered position.

4. An adjustable lounge chair as set forth in claim 1 which further includes a pair of U-shaped brackets, each said bracket being fixed to said seat frame and pivotally secured to said back frame to pivotally connect said back frame to said seat frame.

5. A lounge chair comprising a tubular seat frame defining a first leg support;

an arm frame pivotally connected to said seat frame and having a member defining a second leg support and a pair of fixed arms, and a pair of parallel telescoping arms, each telescoping arm of said member being slidably received in a respective fixed arm; and a tubular back frame pivotally mounted at one end on said seat frame to move between a raised upright position and a lowered reclined position, said back frame being secured to each telescoping arm and having a projecting portion at an opposite end to define a third leg support in said lowered position.

6. An adjustable lounge chair as set forth in claim 5 wherein each telescoping arm is a tube slidably mounted in a respective fixed arm and pivotally secured at one end to said back frame.

7. An adjustable lounge chair as set forth in claim 7 which further includes an aperture in each respective arm and a spring biased button housed within a respective telescoping arm for projection through a respective aperture in said raised position.

8. An adjustable lounge chair having an arm frame including a U-shaped one-piece tubular metal member defining a pair of parallel tubular arms and a leg support, and a pair of telescoping tubes, each said tube being slidably mounted in a respective arm; and a pivotally mounted back frame for moving between a raised upright position and a lowered reclined position, said back frame being pivotally connected at intermediate points to one end of each respective tuber of said arm frame; and means in said arm frame for releasably holding said back frame in said raised position.

9. An adjustable lounge chair as set forth in claim 8 wherein said means includes an aperture in each respective arm and a spring biased button housed with a respective tube for projection through a respective aperture in said raised position.

10. An adjustable lounge chair as set forth in claim 9 wherein said back frame includes a generally U-shaped one-piece tubular member defining a second leg support in said reclined position.

* * * * *

UNITED STATES PATENT AND TRADEMARK OFFICE

CERTIFICATE OF CORRECTION

PATENT NO. : 4,867,505

DATED : September 19, 1989

INVENTOR(S) : Paul H. Parker

It is certified that error appears in the above-identified patent and that said Letters Patent is hereby corrected as shown below:

Column 1, line 18 "and" (first occurrence) should be -an-
Column 4, line 36 "supportin" should be -support in-
Column 6, line 5 "tuber" should be -tube- Signed and Sealed this First Day of January, 1991

*Attest:*

HARRY F. MANBECK, JR.

*Attesting Officer*

*Commissioner of Patents and Trademarks*